US009717976B2

(12) United States Patent
Elphick

(10) Patent No.: US 9,717,976 B2
(45) Date of Patent: Aug. 1, 2017

(54) RIDABLE BOARD ASSEMBLIES AND COMPONENTS THEREOF

(71) Applicant: David Elphick, Belair (AU)

(72) Inventor: David Elphick, Belair (AU)

( * ) Notice: Subject to any disclaimer, the term of this patent is extended or adjusted under 35 U.S.C. 154(b) by 0 days.

(21) Appl. No.: 14/909,229

(22) PCT Filed: Aug. 1, 2014

(86) PCT No.: PCT/AU2014/000769
§ 371 (c)(1),
(2) Date: Feb. 1, 2016

(87) PCT Pub. No.: WO2015/013750
PCT Pub. Date: Feb. 5, 2015

(65) Prior Publication Data

US 2016/0184688 A1 Jun. 30, 2016

(30) Foreign Application Priority Data

Aug. 1, 2013 (AU) ..... 2013902864

(51) Int. Cl.
*A63C 5/03* (2006.01)

(52) U.S. Cl.
CPC ..... *A63C 5/031* (2013.01); *A63C 2203/46* (2013.01)

(58) Field of Classification Search
CPC ..... A63C 5/031; A63C 2203/46
See application file for complete search history.

(56) References Cited

U.S. PATENT DOCUMENTS 4,114,913 A * 9/1978 Newell ..... A63C 1/00 280/14.21
4,116,455 A * 9/1978 Dotson ..... A63C 5/031 280/13
4,138,128 A * 2/1979 Criss ..... A63C 5/031 280/14.21

(Continued)

FOREIGN PATENT DOCUMENTS

| | | | |
|---|---|---|---|
| CA | 2014277 | A1 | 10/1990 |
| EP | 00557872 | A1 | 9/1993 |
| FR | 002439030 | A1 | 5/1980 |

OTHER PUBLICATIONS

Oct. 3, 2014 International Search Report issued in International Patent Application No. PCT/AU2014/000769.

(Continued)

*Primary Examiner* — Brian Swenson
(74) *Attorney, Agent, or Firm* — Oliff PLC

(57) ABSTRACT

A snowboard assembly is disclosed that includes a deck supported above a pair of longitudinally spaced apart blades. The deck has an upper surface for supporting a rider thereon and each blade has a lower surface for contacting ice or snow upon which the snowboard assembly is ridden. The deck is supported above the blades by mounts that are interposed between each blade and the deck. The deck is torsionally rigid between the mounts such that, in use, rider induced weight transfer forces are able to be transferred from the deck through one or both mounts and into one or both blades in order to steer the assembly. The mounts may be truck assemblies which enable the blades to move independently with respect to the deck.

25 Claims, 14 Drawing Sheets

(56) References Cited

U.S. PATENT DOCUMENTS 4,161,323 A * 7/1979 Wetteland ..... A63C 5/031 280/13
4,221,394 A * 9/1980 Campbell ..... A63C 10/005 280/14.25
5,022,668 A * 6/1991 Kenny ..... A63C 5/03 280/11.28
5,249,816 A * 10/1993 Southworth ..... A63C 5/031 280/14.25
6,341,786 B1 * 1/2002 Kermis ..... A63C 5/031 280/14.22
6,648,348 B2 * 11/2003 Link ..... A63C 5/031 280/14.25
7,040,634 B1 * 5/2006 Elkins, Jr. ..... A63C 5/031 280/14.25
7,581,735 B2 * 9/2009 Birdsell ..... A63C 5/031 280/14.21
8,632,079 B2 * 1/2014 Ryan ..... A63C 5/03 280/14.21
2002/0070515 A1 * 6/2002 Barbieri ..... A63C 5/03 280/14.21
2008/0048415 A1 * 2/2008 Mann ..... A63C 5/02 280/601
2008/0246255 A1 * 10/2008 Hallsten ..... A63C 5/031 280/606
2013/0106068 A1 * 5/2013 Franko ..... A63C 5/02 280/11.15

OTHER PUBLICATIONS

Oct. 3, 2014 Written Opinion issued in International Patent Application No. PCT/AU2014/000769.
Nov. 28, 2016 Office Action issued in Chinese Patent Application No. 201480051837.7.
Feb. 13, 2017 European Search Report issued in European Patent Application No. EP14831768.

* cited by examiner

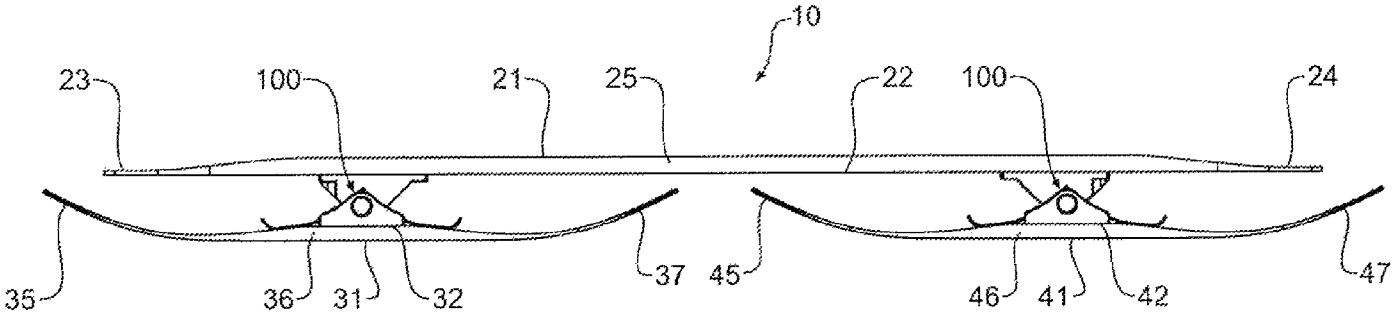
Figure 2
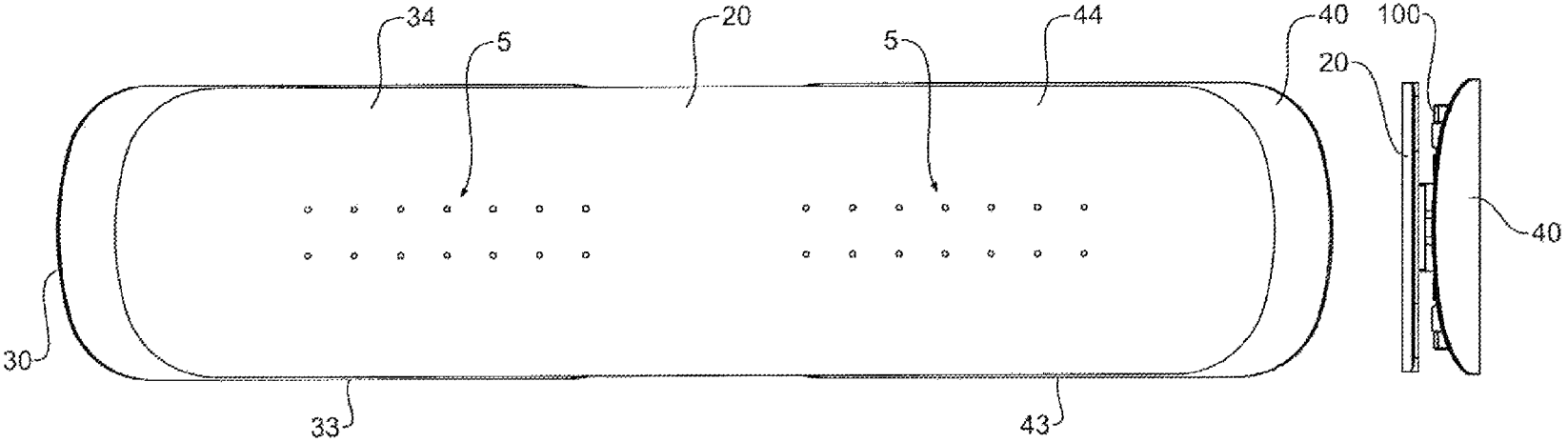
Figure 3
Figure 4

RIDABLE BOARD ASSEMBLIES AND COMPONENTS THEREOF

PRIORITY DOCUMENTS

The present application claims priority from:

Australian Provisional Patent Application No. 2013902864 titled "RIDABLE BOARD ASSEMBLIES AND COMPONENTS THEREOF" and filed on 1 Aug. 2013;

The content of this application is hereby incorporated by reference in its entirety.

TECHNICAL FIELD

The present invention relates generally to ridable board assemblies and components thereof. In a particular form, the invention relates to a snowboard assembly having variable tuning capabilities.

BACKGROUND

A snowboard has a multi-layered construction including at least a P-tex base for gliding over snow, an inner core and a top sheet. A snowboard also has metal edges inserted along the sides of the board for cutting into snow or ice to enable the board to turn. The metal edges are curved and have a radius known in the art as a sidecut. The sidecut of a snowboard determines the turning characteristics of the board. A board having a deeper sidecut (i.e., larger radius) will turn more sharply than a board having a shallower sidecut (i.e. smaller radius). A snowboard's construction also determines its flex and stiffness characteristics. All of these parameters, including the length and width of the board, are fixed for any given board. If a user requires different settings, for example to handle different snow conditions, then a new board is required.

A snowboard is controlled by the leading edge of the board only, which means that a user can only initiate a turn off of the front foot. A problem with this, particularly for beginners is that the automatic fear response is to lean back. Leaning back nullifies the turning action and can result in the board catching edges which may cause accident and injury. Furthermore, other board sports including surfing, skate-boarding, wakeboarding and kiteboarding all enable a user to drive a turn off of the back fool which is a more natural ride style.

There is thus a need to provide an improved snowboard assembly that better replicates the riding style of these other board sports while also providing the ability to vary and tune parameters such as sidecut, length, and flex response to alter the board's performance and handling characteristics.

It is against this background and the problems and difficulties associated therewith that the present invention has been developed.

Certain objects and advantages of the present invention will become apparent from the following description, taken in connection with the accompanying drawings, wherein, by way of illustration and example, several embodiments of the present invention are disclosed.

SUMMARY

According to a first aspect, there is provided a snowboard assembly, including:

a pair of longitudinally spaced apart blades, each blade having a bottom surface for contacting ice or snow upon which the snowboard assembly is ridden; and a deck supported above the blades by mounts that are interposed between each blade and the deck, the deck having a top surface for supporting a rider thereon, wherein, the deck is torsionally rigid between the mounts such that, in use, rider induced weight transfer forces are able to be transferred from the deck through one or both mounts and into one or both blades in order to steer the assembly.

In one form, the mounts interposed between each blade and the deck are track assemblies which enable each blade to move independently with respect to the deck.

In one form, for each blade, the truck assembly includes a baseplate securable to a bottom surface of the deck and an elongate member coupled to the blade and pivotally retained with respect to the baseplate.

In one form, the elongate member is retained in a recess or channel formed in the baseplate.

In one form, the elongate member is retained in the recess or channel by a retaining plate, the retaining plate including a pivot pin that extends through the elongate member and into the baseplate and wherein the pivot pin defines a pivot axis about which the elongate member is able to pivot with respect to the baseplate and deck.

In one form, the recess or channel formed in the baseplate restricts an amount that the elongate member is able to pivot about the pivot axis.

In one form, the recess or channel provides tapered surfaces that are contactable with the elongate member and which provide hard stops to restrict the amount that the elongate member is able to pivot about the pivot axis.

Its one form, the pivot axis is angled at substantially 45° with respect to the bottom surface of the deck.

In one form, the elongate member is coupled to the blade through a pair of spaced apart blade mounts upstanding front a top surface of the blade adjacent opposing lateral edges thereof.

In one form, the blade mounts are pivotally coupled to the elongate member.

In one form, the elongate member is a bar having a rectangular or square cross-section.

In one form, the elongate member has cylindrical end portions and the blade mounts are pivotally coupled to the cylindrical end portions.

In one form, the lick assembly further includes biasing means which act to return the elongate member to a home position with respect to the baseplate.

In one form, the biasing means comprises a pair of laterally spaced apart springs coupled between the baseplate and elongate member that provide resistance against pivotal movement of the elongate member about the pivot axis.

In one form, the truck assembly further includes biasing means which act to return the blade mounts and blade to a home position with respect to the deck.

In one form, the biasing means which act to return the blade counts and blade to a home position with respect to the deck comprises a pair of leaf springs mounted to the elongate member about opposing sides of the baseplate, the leaf springs contactable with the top surface of the blade and operable to provide resistance against pivotal movement of the blade mounts and blade with respect to the elongate member.

In one form, the deck has flexible forward and aft tips contactable with the blades.

In one form, the deck terminates in downwardly sloped sections.

In one form, the blades have flexible upswept tips that are contactable with the deck.

In one form, the flexible upswept tips of each blade are able to flex up under snow pressure, thereby reducing edge contact between the blades and snow to assist tinning in soft or powder snow.

In one form, the blades have straight metal edges or cutting into snow or ice to perform a turn.

In one form, the deck is contactable with the blade mounts when the elongate member pivots thereby providing means to vary the effective sidecut of the snowboard assembly.

In one form, for each blade, the mounts comprise a pair of spaced apart blade mounts upstanding from a top surface of the blade adjacent opposing lateral edges thereof, said blade mounts secured to both the blade and the bottom surface of the deck.

According to a second aspect, there is provided a snowboard assembly, including:

a pair of longitudinally spaced apart blades having upswept flexible tips, each blade having a bottom surface for contacting ice or snow upon which the snowboard assembly is ridden; and a deck having a top surface for supporting a rider thereon and having flexible tips, the deck supported above each blade by a truck assembly that is interposed between each blade and the deck, wherein, the deck is torsionally rigid between each truck assembly such that, in use, rider induced weight transfer forces are able to be transferred from the deck through one or both truck assemblies and into one or both blades in order to steer the assembly and wherein the flexible tips of the deck are contactable with the blades and the flexible tips of the blades are contactable with the deck.

According to a third aspect, there is provided a truck assembly mountable between a blade contactable with ice or snow to a deck spaced above the blade for supporting a rider thereon, the truck assembly including:

a baseplate securable to a bottom surface of the deck;

a pair of laterally spaced apart blade mounts securable to a top surface of the blade adjacent opposing edges thereof;

an elongate member coupled to each blade mount and retained in a recess or channel formed in the baseplate; and a retaining plate for retaining the elongate member in the recess or channel formed in the baseplate, the retaining plate having a pivot pin that extends through the elongate member and into the baseplate, wherein, the pivot pin defines a pivot axis about which the elongate member is able to pivot with respect to the baseplate and deck.

BRIEF DESCRIPTION OF DRAWINGS

Embodiments of the present invention will be discussed with reference to the accompanying drawings wherein:

FIG. 2 is a side view of the snowboard assembly of FIG. 1;

FIG. 3 is a top view of the snowboard assembly of FIG. 2;

FIG. 4 is an end view of the snowboard assembly of FIG. 2;

In the following description, like reference characters designate like or corresponding parts throughout the figures.

DESCRIPTION OF EMBODIMENTS

Figure 1:
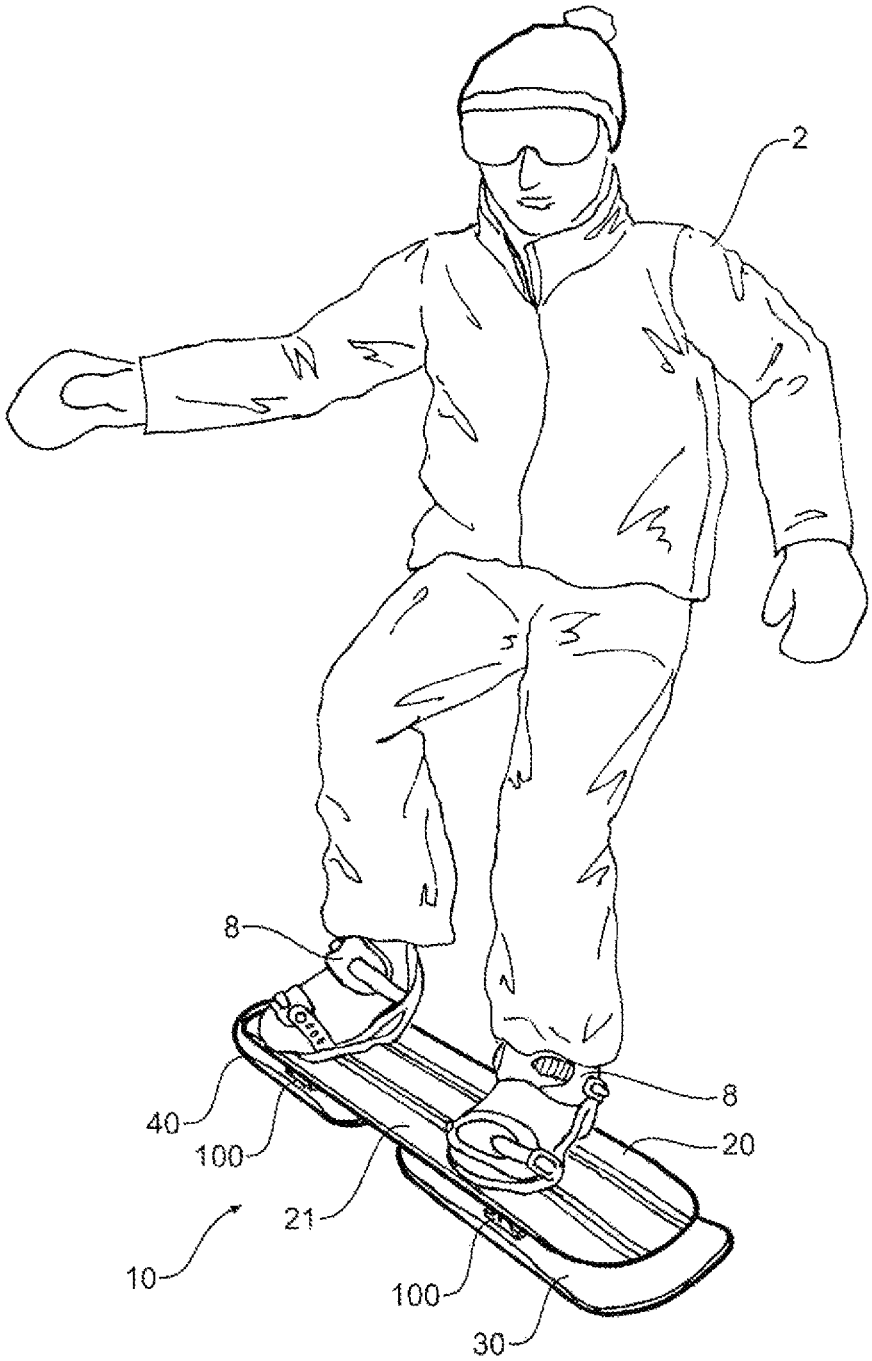
FIG. 1 is a schematic representation of a snowboarder riding a snowboard assembly according to an embodiment.

Referring now to FIG. 1, there is shown a schematic representation of a rider 2 (e.g. a snowboarder) riding a snowboard assembly 10 according to an embodiment of the invention. The snowboard assembly 10 includes a pair of longitudinally spaced apart blades 30, 40, each blade having a lower or bottom surface for contacting ice or snow upon which the snowboard assembly 10 is ridden. The snowboard assembly 10 further includes an elongate deck or board 20 supported above the blades 30, 40 by mounts 100 that are interposed between each blade 30, 40 and the deck 20. The deck has a top or upper surface 21 for supporting a rider 2 thereon that stands on the deck 20 as shown. The rider 2 is secured to the deck 20 by conventional bindings 8 that receive snowboard boots. The bindings 8 are mounted to the top surface 21 of the deck 20. There may be multiple mounting positions 5 for the bindings (see FIG. 3) to enable the rider to adjust their stance width. With respect to the back foot of the rider 2, a suitable position for the rear binding may be slightly rearward of the mount 100.

Referring now to FIGS. 2-4, side, top and end views of the snowboard assembly 10 are shown. The deck 20 further includes a bottom surface 22, midsection 25 and forward and aft tips (23, 24) which may be downwardly sloped sections. Unlike a conventional snowboard, the deck 20 is elevated or raised off of a ground surface (i.e. snow or ice).

The pair of longitudinally spaced apart (in-line) blades (also known as skids or runners) 30, 40 are contactable with snow or ice upon which the snowbound assembly 10 is ridden. The forward blade 30 has a bottom surface 31 which presents a surface area to glide over snow, a top surface 32, forward tip 35, aft tip 37 and midsection 36. Forward blade 30 further includes metal edges 33, 34 that may be toe side or heel side edges depending upon the orientation of the rider on the snowboard assembly. In the embodiment shown in FIGS. 1-4, the metal edges 33, 34 are straight. Similarly, aft blade 40 has a bottom surface 41 which presents a surface area to glide over snow, a top surface 42, forward tip 45, aft tip 47 and midsection 46. Aft blade 40 further includes metal edges 43, 44 that may be toe side or heel side edges depending upon the orientation of the rider on the snowboard assembly. In the embodiment shown in FIGS. 1-4, the metal edges 43, 44 are also straight. The midsections 36, 46 of each blade 30, 40 are torsionally rigid while the forward and aft tips of each blade 30, 40 are upswept flexible tips that are able to flex under load. Multiple blade lengths may be used ranging for example between 500-800 mm.

Each blade 30, 40 is independently mounted to the deck 20 by mounts 100 associated with each blade 30, 40. The blades 30, 40 are mounted so that they are longitudinally aligned with a longitudinal axis of the deck 20. The deck 20 is torsionally rigid between the mounts 100 associated with each blade 30, 40 to enable forces to be transferred from the deck 20 through the mounts 100 and into each blade 30, 40. In particular, the deck 20 is torsionally rigid between the mounts 100 such that, in use, rider induced weight transfer forces are able to be transferred from the deck 20 through one or both mounts 100 and into one or both blades 30, 30 in order to steer the assembly 10.

The deck 20 and blades 30, 40 may be manufactured from standard composite materials that are well known and widely used in the ski and snowboard industry. For example, a Ptex base may be used in combination with a wood, foam or aluminium honeycomb core and fibreglass layers that sandwich the core. The torsionally rigidity of the deck between the mounts may be increased by increasing the thickness of the deck for a given material construction or by using an alternative composite construction.

The mounts interposed between each blade 30, 40 and the deck 20 shown in FIGS. 1-4 are truck assemblies 100 which enable each blade 30, 40 to move independently with respect to the deck 20. Each truck assembly 100 enables the rider 2 to steer the snowboard assembly 10 and execute turning maneuvers in a similar way that a skateboard truck enables a skateboard to turn.

Unlike a conventional skateboard truck assembly, truck assembly 100 has been engineered specifically for the snowboarding environment. Truck assembly 100 has a lower profile (i.e. height) than a conventional skateboard truck as well as limited articulation and greater ability to withstand higher loads than a conventional skateboard truck.

A rider may initiate a turn off of their front or back foot. A turn initiated by displacing weight over the front foot will cut an edge of the forward blade 30 into the snow. Similarly, a turn initiated by displacing weight over the rear foot will cut an edge of the aft blade 40 into the snow. A conventional ski or snowboard is controlled by the leading edge of the board only, which means that a user can only initiate a turn off of the front foot. A problem with this, particularly for beginners is that the automatic feat response is to lean back. Leaning back nullifies the turning action and can result in the board catching edges which may cause accident and injury. The snowboard assembly 10 of the present invention overcomes this deficiency by allowing a user to initiate a turn off of the back foot (i.e. with weight displaced backwards).

The ability to drive a turn from the back foot mirrors the riding style of other board sports including surfing, skateboarding, wakeboarding and kiteboarding. The snowboard assembly 10 therefore makes a user's transition from these other board sports to snowboarding easier.

In hard packed snow or icy conditions, the snowboard assembly 10 turns by cutting the edges 33, 34, 43, 44 of the blades 30, 40 into the snow. In soft or powder snow, the forward and aft tips of the blades 30, 40 flex up under snow pressure, thereby reducing edge contact between the blades 30, 40 and snow to assist in initiating a turn.

Figure 5:
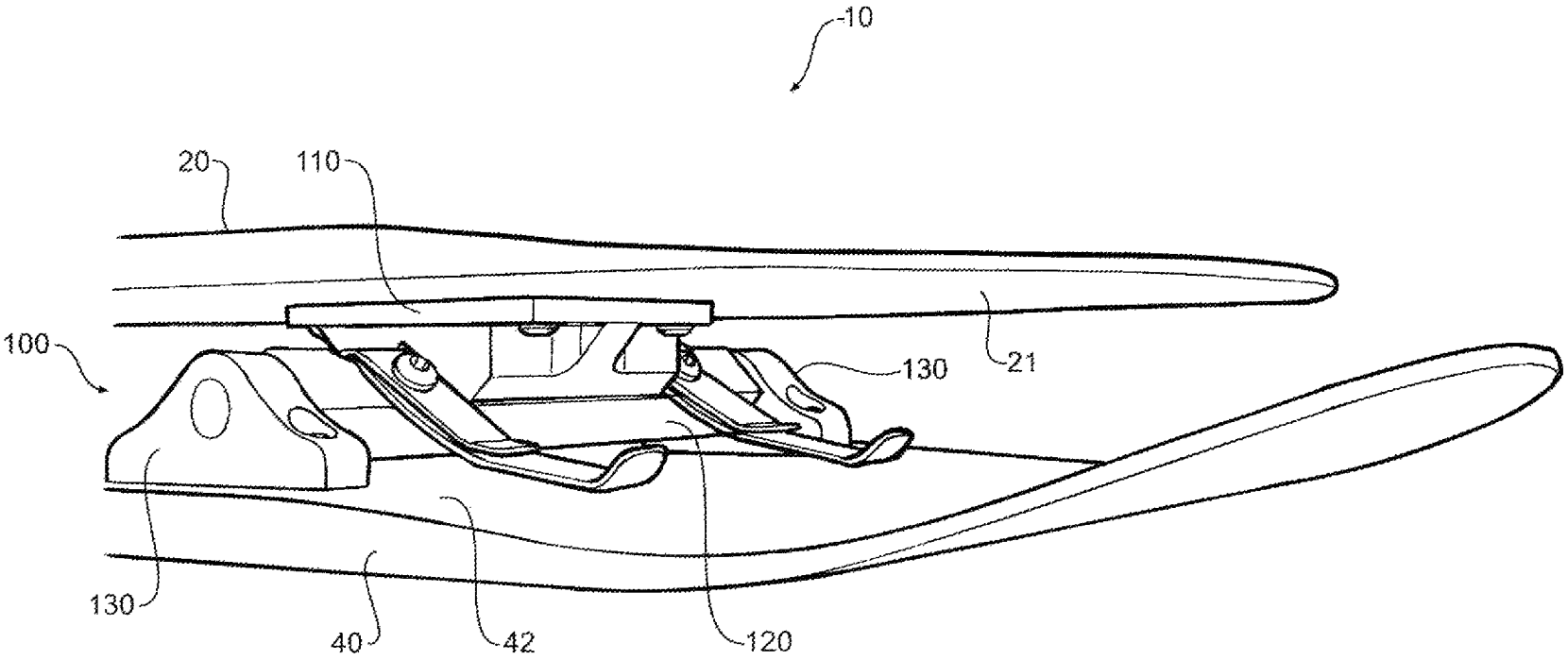
FIG. 5 is a detailed perspective view of a truck assembly mounted between a deck and a blade of the snowboard assembly.

Referring now to FIGS. 5-13, truck assembly 100 is described in further detail. For each blade 30, 40 the truck assembly 100 includes a baseplate 110 having a top surface 111 that is mounted to the bottom surface 22 of the deck 20 as shown in FIG. 5. The baseplate 110 may be mounted to the bottom surface 22 of the deck 20 by screws, bolts or other suitable fastening means 51 and lock washers 52 as shown in the exploded view of the truck assembly 100 in FIG. 6B. The baseplate 110 further includes side portions 112, 113, and tapered end portions 114, 115. The baseplate 110 is adapted to receive and retain a hanger 120. The hanger 120 is an elongate member as shown.

Figure 6A:
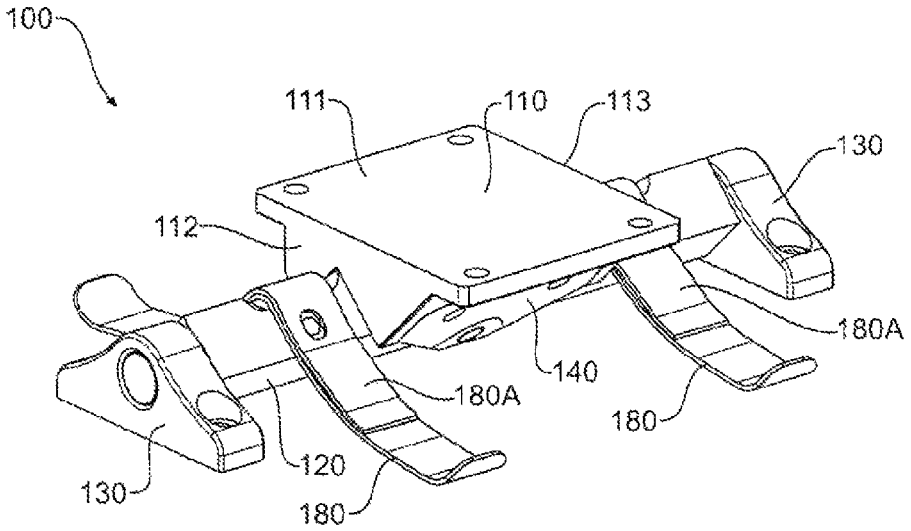
FIG. 6A is a top perspective view of the truck assembly shown in FIG. 5.
Figure 6B:
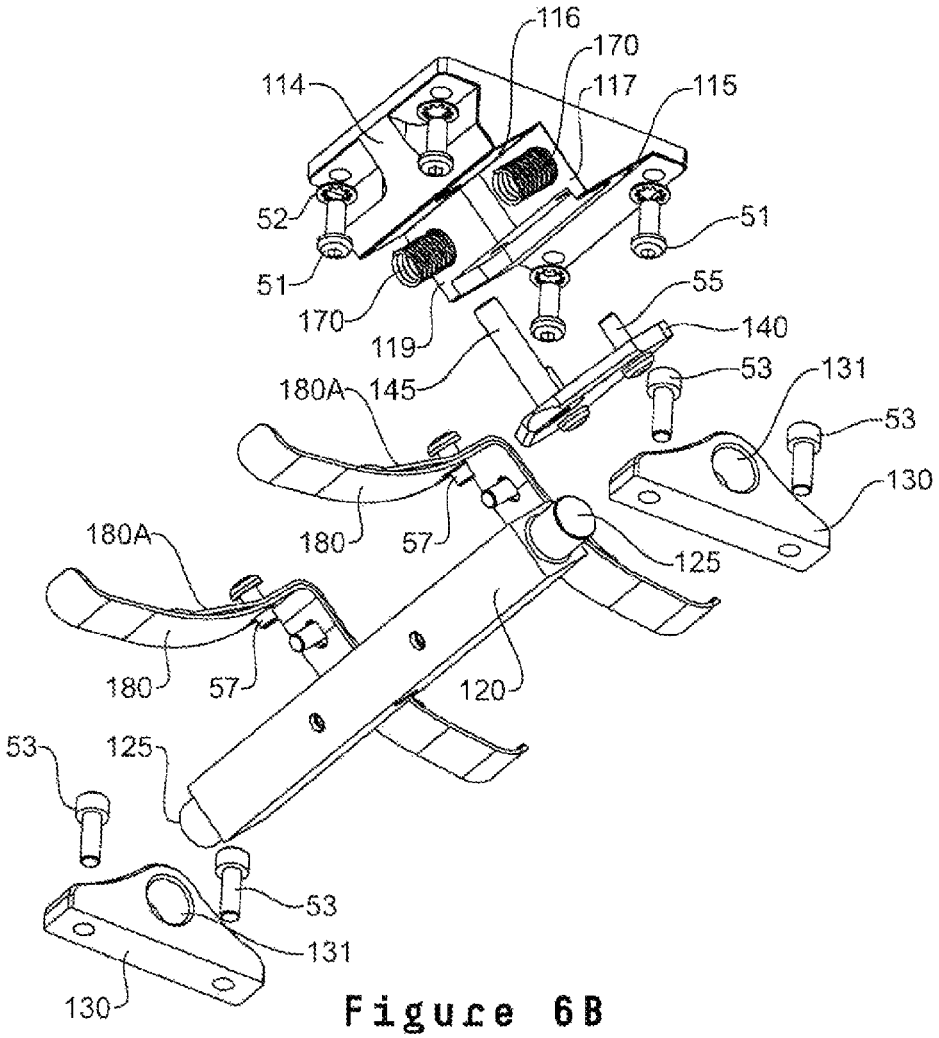
FIG. 6B is an exploded view of the truck assembly of FIG. 6A.
Figure 7:
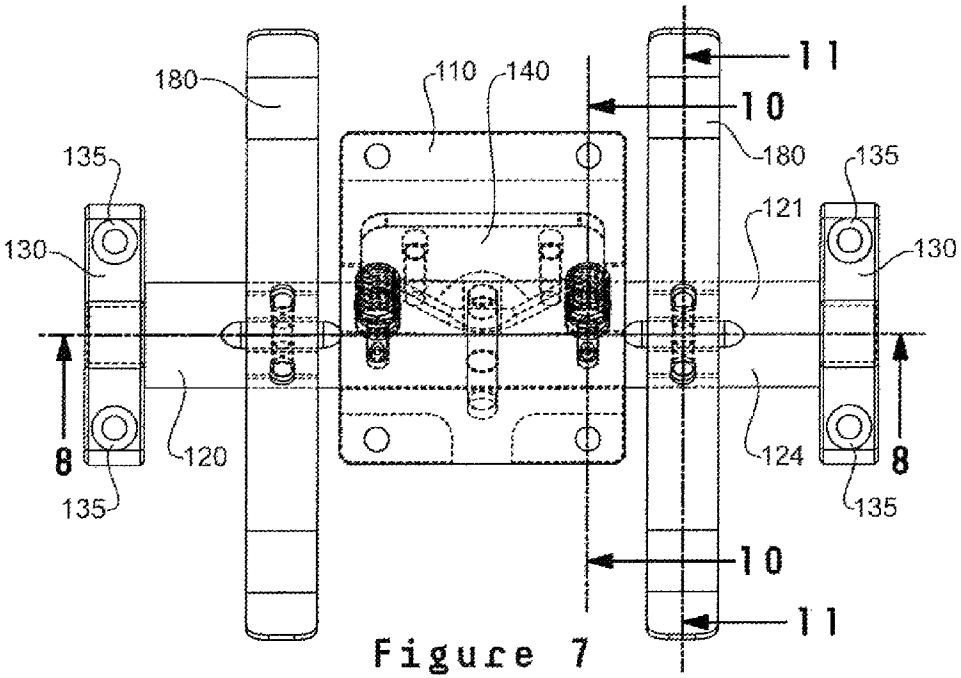
FIG. 7 is a top view of the truck assembly of FIG. 6A showing hidden features in dashed lines.
Figure 8:
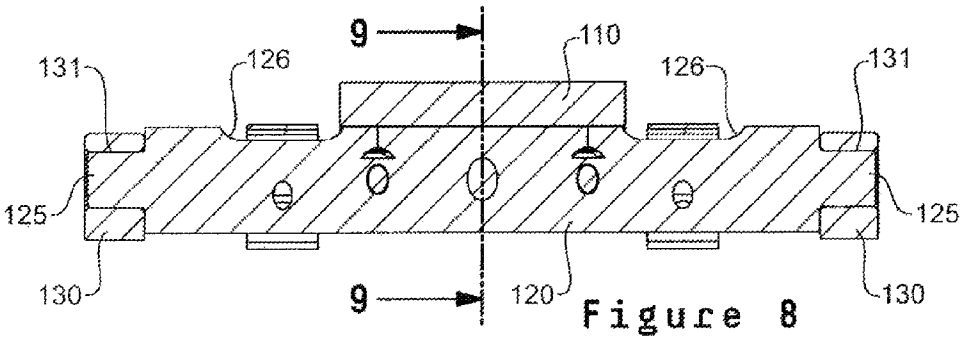
FIG. 8 is a sectional view of the truck assembly taken through section 8-8 of FIG. 7.
Figure 12:
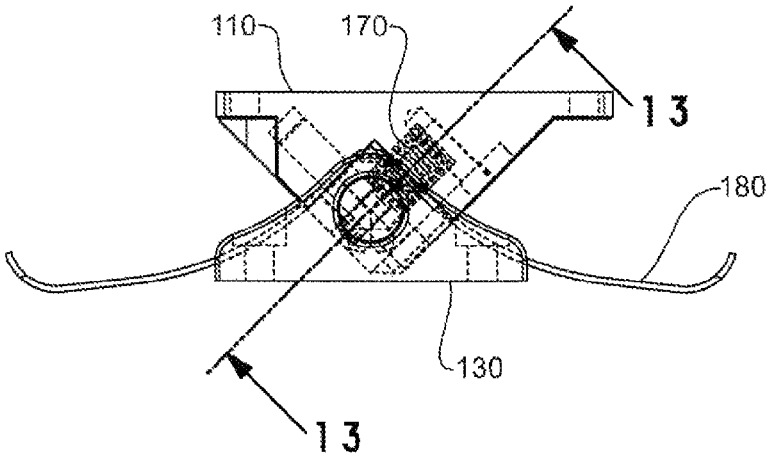
FIG. 12 is an end view of the truck assembly of FIG. 6A showing hidden features in dashed lines.

In a preferred form, the hanger 120 is an elongate bar having a rectangular or square cross-section. The hanger 120 extends laterally for transversely) with respect to the deck 20, through the baseplate 110 and slots into an open recess or channel machined or formed into the baseplate 110. The channel is defined by inner surfaces 116, 117 and 119 of the baseplate 110 as shown in FIG. 6B. In the embodiment shown, the inner surfaces 117, 119 are angled at substantially 45° to the bottom surface 22 of the deck 20. The hanger 120 has surfaces 121, 124 that nest within the channel of the baseplate 110 as shown in FIG. 7. Surface 124 is aligned with inner surface 116 of the baseplate 110.

Figure 9:
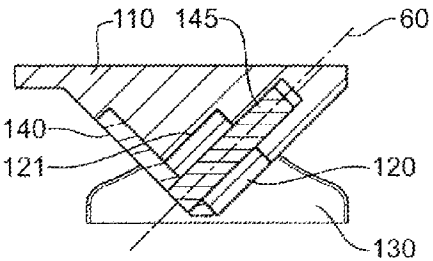
FIG. 9 is a sectional view of the truck assembly taken through section 9-9 of FIG. 8.

The hanger 120 is held or retained with respect to the baseplate 110 by a retaining plate or faceplate 140. The faceplate 140 has a pivot pin 145 depending therefrom which is inserted through an aperture in the hanger 120 and into an aperture of the baseplate 110. The pivot pin 145 defines a pivot axis 60 about which the hanger 120 is able to pivot with respect to the baseplate 110 and deck 20 as shown in FIG. 9. The faceplate 140 is seated in a recess formed in tapered end portion 115 of the baseplate 110 and mounted thereto by screws 55 or other suitable fasteners.

The truck assembly 100 further includes a pair of spaced apart blade mounts 130 that are upstanding from each blade 30, 40 and in one form securable to each blade by fasteners 53 (e.g. bolts) through holes 135. The blade mounts 130 are located in the midsections 36, 46 of the blades 30, 40 adjacent opposing lateral edges thereof. As shown in FIGS. 5-13, the hanger 120 has cylindrical end portions 125 that are coupled to the blade mounts 130 through apertures 131. The blade mounts 130 are pivotally coupled to the hanger 120 thereby permitting the blade mounts 130 and blades 30, 40 to pivot fore and aft with respect to the deck 20.

Figure 14:
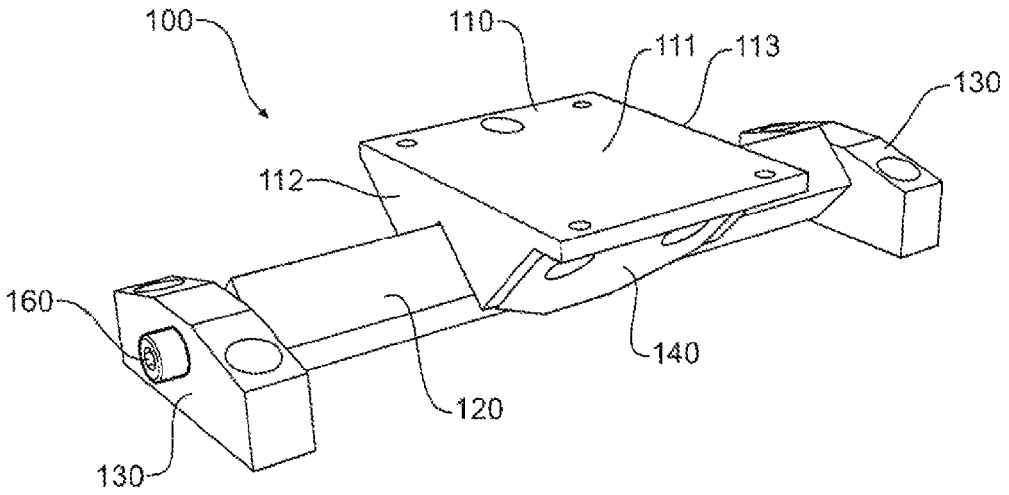
FIG. 14 is a top perspective view of a truck assembly according to a further embodiment.
Figure 15:
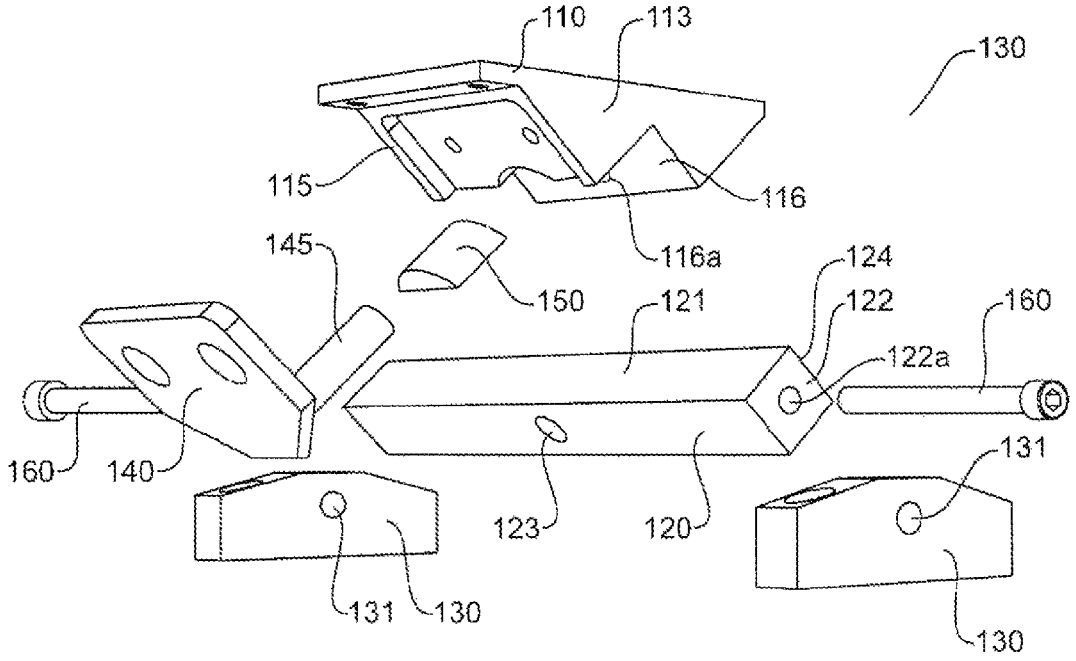
FIG. 15 is an exploded view of the truck assembly of FIG. 14.

In an alternative form shown in FIGS. 14-15 the hanger 120 does not have cylindrical end portions. The hanger 120 is a bar having a square cross section and ends 122 that abut opposing blade mounts 130. The blade mounts 130 have apertures 131 that are axially aligned with apertures 122*a* located in the ends 122 of the hanger 120. An axle bolt 160 is inserted through each blade mount 130 and through the ends 122 of the hanger 120 to thereby pivotally couple each blade mount 130 to the hanger 120. The hanger 120 is again retained with respect to the baseplate 110 by faceplate 140 having a pivot pin 145 extending therefrom that is inserted through aperture 123 in the hanger 110 and into aperture 116*a* of the baseplate 110. The truck assembly 100 may further include a wear plate 150 that is seated in recess 118 of the baseplate 110.

The truck assembly 100 is required to be lightweight having high strength and impact resistance. Suitable materials would include lightweight metals such as aluminium and titanium. The blade mounts may be metal or alternatively can be a high strength plastic material.

Figures 10, 11:
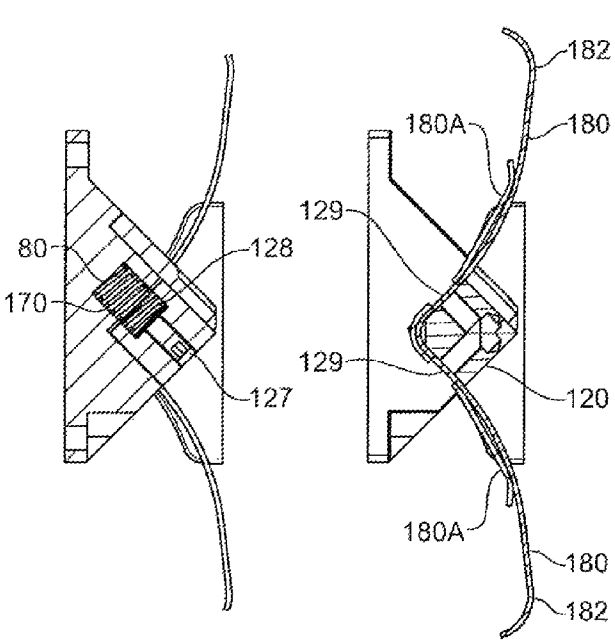
FIG. 10 is a sectional view of the truck assembly taken through section 10-10 of FIG. 7.
FIG. 11 is a sectional view of the truck assembly taken through section 11-11 of FIG. 7.
Figure 13:
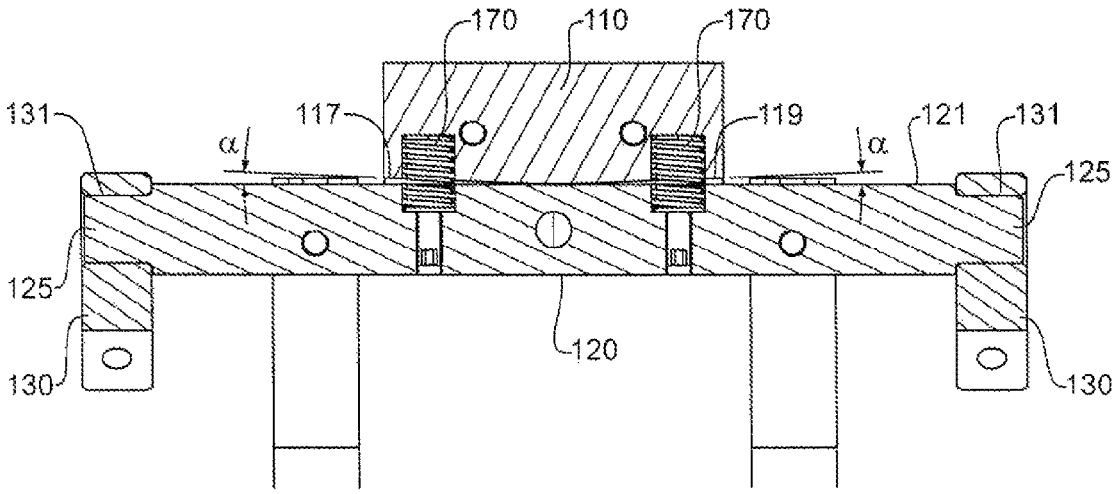
FIG. 13 is a sectional view of the truck assembly taken through section 13-13 of FIG. 12.

With reference to FIGS. 6A-13, the truck assembly 100 further includes biasing means 170 which act to return the hanger 120 to a home position with respect to the baseplate 110. The home position is a balanced or neutral straight lining position as shown in FIG. 13. In one form, the biasing means are a pair of laterally spaced apart springs 170 coupled between the baseplate 110 and hanger 120 that provide resistance against pivotal movement of the hanger 120 about the pivot axis 60. The springs 170 are internal springs that are located in bores 80 set into surfaces 117, 119 respectively of the baseplate 110 as shown in FIG. 10. The springs 170 are also received in bores 128 in the hanger 120. The spring stiffness will determine the feel of the snowboard assembly 10 when turning. As the spring stiffness, increases, a more progressive turn can be enacted which provides the rider with more control when turning. As a rider leans further into a turn, the higher spring force is slowly overcome and the hanger 120 will pivot further towards its maximum articulation. The internal springs 170 allow a rider to control the effective sidecut of the snowboard assembly 10 when executing a turn. The internal springs 170 may be replaced by nylon bushings or accurate micro gas filled shock absorbers in other embodiments.

The truck assembly 100 may further include biasing means which act to return the blade mounts 130 and blades 30, 40 to a home position with respect to the deck 20. In one form, the biasing means comprise a pair of leaf springs 180 mounted to the hanger 120 about opposing sides 112, 113 of the baseplate 110. A portion 182 of the leaf springs 180 is contactable with the top surfaces 32, 42 of the blades 30, 40. The leaf springs 180 are therefore operable to provide resistance against pivotal movement of the blade mounts 130 and blades 30, 40 with respect to the hanger 120.

The leaf springs 180 as shown in FIGS. 5-13 control the undulation response of the snowboard assembly 10 as it traverses across the ice or snow in order to provide a smoother ride and support the assembly over bumps etc. Referring to FIG. 6A and FIG. 11, a secondary leaf spring 180A may overlay the primary leaf spring 180 as a means to vary the flex response. The leaf springs 180 are located over recessed portions 126 of the hanger 120 and fastened thereto by locking grub screws 57 or other suitable fasteners. The leaf springs 180, 180A may be mounted over the top of the hanger 120 (as shown in FIG. 6A) or alternatively may be mounted below the hanger or in yet further embodiments may be adapted to encapsulate the hanger such that the hanger is slidably engaged within the leaf spring. The leaf springs 180 are set along the lengthwise direction of each blade 30, 40 and are adapted to provide resistance to the pivotal movement of the blade mounts 130 and blade 30, 40 with respect to the hanger 120. The tension of the leaf springs 180 is set so that blades 30, 40 are returned to a safe neutral position (home position) when not under load. Without the undulation spring resistance provided by leaf springs 180, the blade 30, 40 may drop and dig into the snow when landing aerial maneuvers which may lead to damage and injury. A 0.9 mm thick leaf spring provides sufficient tension to return the blades 30, 40 to a horizontal neutral position. In some embodiments, undulation may be eliminated altogether by using a thicker leaf spring (e.g. 2.4 min thick) which locks the blades 30, 40 into a pre-determined position. If the blades 30, 40 cannot pivot about the hanger 120, the loading (e.g. from bumps in terrain etc.) will be transferred into the forward and aft tips of the blades resulting in a flex response similar to a conventional ski or snowboard.

Figure 19:
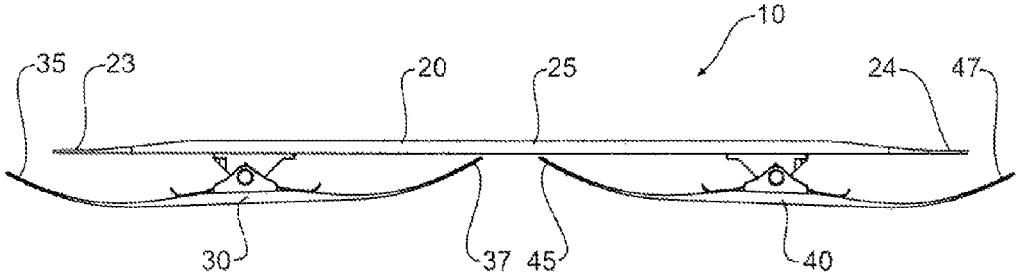
FIG. 19 is a side view of the snowboard assembly having a camber profile.
Figure 20:
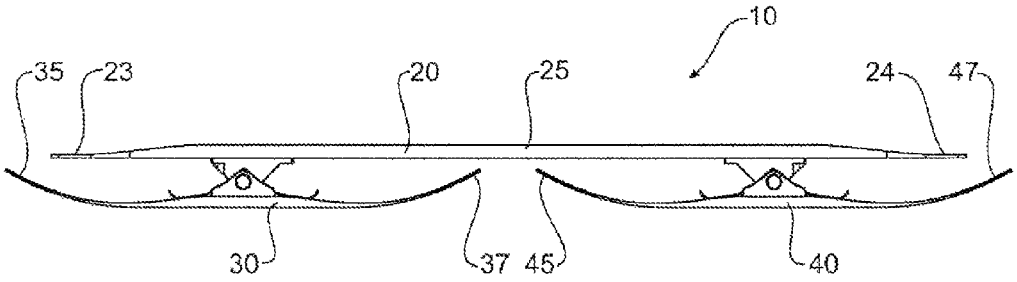
FIG. 20 is a side view of the snowboard assembly having a neutral profile.
Figure 21:
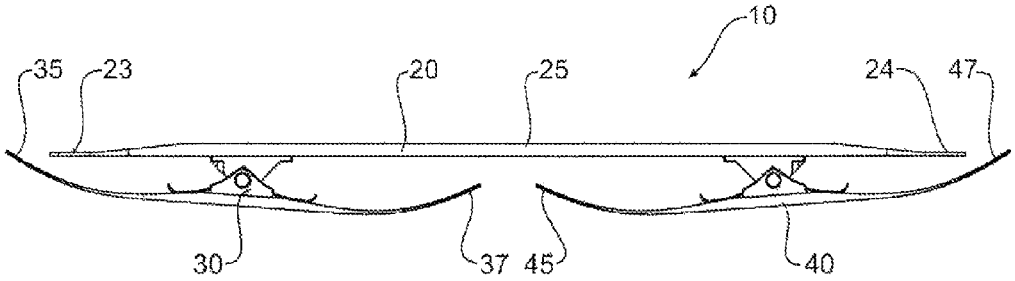
FIG. 21 is a side view of the snowboard assembly having a rocker profile.

The leaf springs 180 for the forward and aft blades 30, 40 may be designed to achieve various settings such as camber, neutral and rocker as illustrated in FIGS. 19-21. FIG. 19 depicts the snowboard assembly 10 set in camber whereby the aft tip 37 of the forward blade 30 and the forward tip 45 of the aft blade 40 are raised off of the snow. A camber profile offers improved handling and power on groomed terrain and harder snow, but requires precise turn initiation. The tips 37, 45 of the blades 30, 40 may interact with the midsection 25 of the deck to vary the flex response of the board. FIG. 20 illustrates the blades 30, 40 set in a neutral position whereby the bottom surfaces of the blades 30, 40 are parallel to deck 20. FIG. 21 depicts the snowboard assembly 10 set in rocker whereby the forward tip 35 of the forward blade 30 and the aft tip 47 of the aft blade 40 are raised off of the snow. This configuration provides float in soft snow conditions and increases ease of turn initiation.

Figure 23:
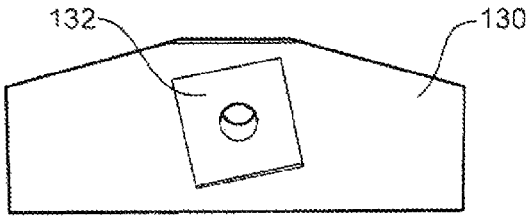
FIG. 23 is a side view of a blade mount having a keyed recess.

An alternative way to eliminate the undulation of the blades 30, 40 is to key the hanger 120 (of the type shown in FIGS. 14-15) into the end of the blade mounts 130 as illustrated in FIG. 23. The end 122 of hanger 120 is locked into keyway (recess) 132 which prevents relative rotation between the blade mount 130 and hanger 120. When the hanger 120 is keyed to the blade mount 130, the loading (e.g. from bumps in terrain etc.) will be transferred into the forward and aft tips of the blades 30, 40 resulting in a flex response. By rotating the keyway 132 in the blade mount 130, the blades 30, 40 can be set into camber, neutral or rocker.

The truck assembly 100 shown in FIGS. 5-13 has limited articulation to ensure that the truck assembly is functional in the snowboarding environment. FIG. 13 illustrates how pivotal movement of the hanger 120 with respect to the baseplate 110 is limited by limiting surfaces 117, 119. The hanger 20 pivots about pivot axis 60 however limiting surfaces 117, 119 provide a hard stop to limit or restrict the amount of pivotal movement that the truck assembly 100 has. In operation, the hanger 120 can only pivot $\alpha°$ about its pivot point. In a preferred form, $\alpha$ is in the range of 2-3°.

Figure 16:
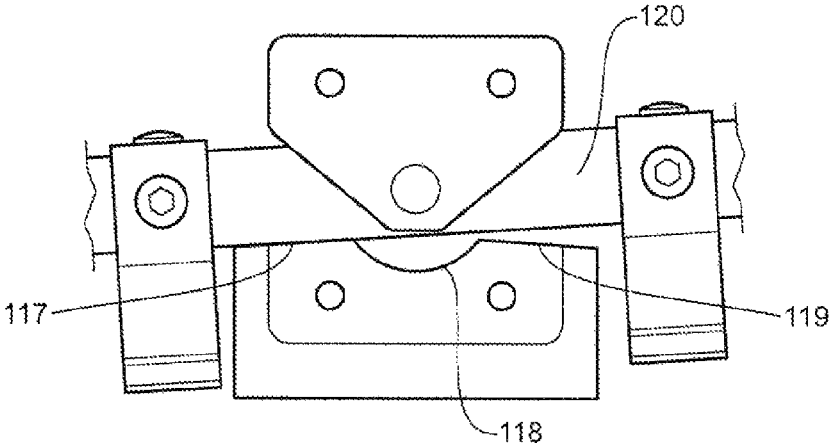
FIG. 16 is a rear perspective view of the truck assembly of FIG. 14 showing the limited port turning action of the hanger of the truck assembly.
Figure 17:
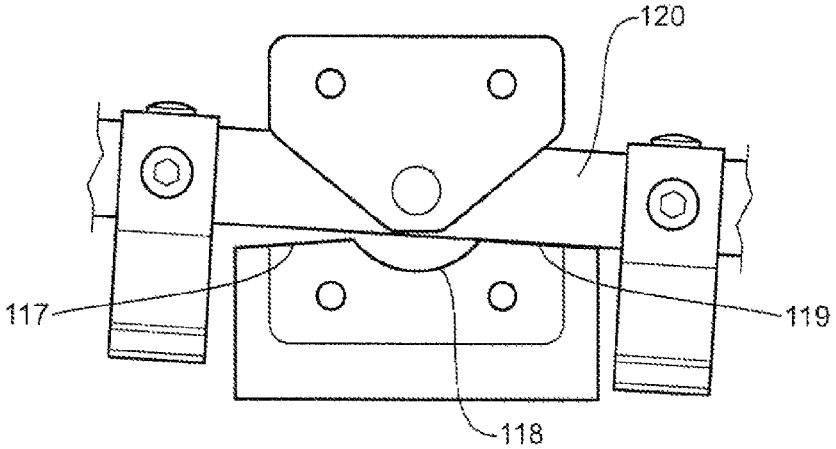
FIG. 17 is a rear perspective view of the truck assembly of FIG. 14 showing the limited starboard turning action of the hanger of the truck assembly.
Figure 18:
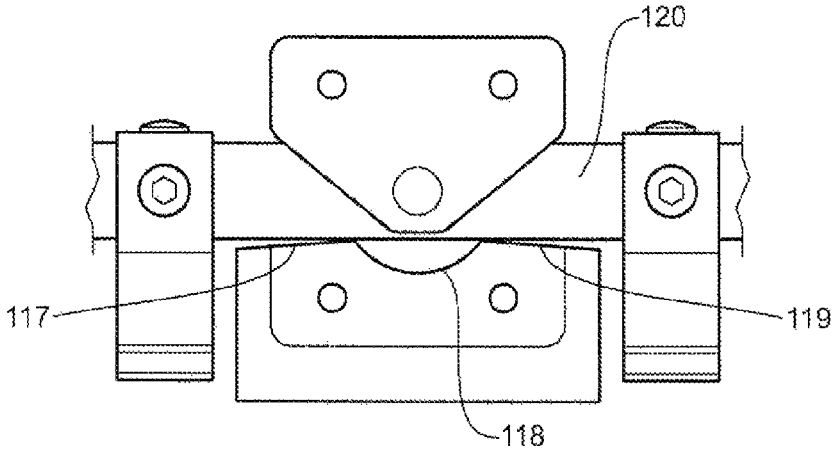
FIG. 18 is a rear perspective view of the truck assembly of FIG. 14 showing the straight lining position of the hanger of the truck assembly.

With respect to the truck assembly 100 shown in FIGS. 14 and 15, the limited articulation is schematically represented in FIGS. 16-18, which show port turning, starboard turning and straight lining respectively. FIG. 16 shows the hanger 120 at maximum angular displacement when port turning. Further rotation or pivoting of the hanger 120 is prevented by limiting surface 117 of the baseplate 110. Likewise, FIG. 17 shows the hanger 120 at maximum angular displacement when starboard turning. Further rotation or pivoting of the hanger 120 is prevented by limiting surface 119 of the baseplate 110. The pitch of limiting surfaces 117, 119 may be increased or decreased to change the allowable pivoting action of the truck assembly 100. In the embodiment shown, the end 122 of the hanger 120 is displaced 9 mm from the pivot axis at the centre of the hanger 120 when at maximum articulation. FIG. 18 shows the position of the hanger 120 when the snowboard assembly 10 is straight lining. In this position, surface 121 of the hanger 120 is not in contact with either limiting surface 117, 119. The hanger 120 is orthogonal to the lengthwise axis of the deck 20 when straight lining.

The ability to vary the pivoting action of the hanger 120 allows the effective side cut of the snowboard assembly 10 to vary. A conventional snowboard has curved edges which form an arc of a pre-determined radius. The deeper the sidecut (i.e. smaller radius), the sharper the board will turn. Similarly, for a shallow sidecut (i.e. larger radius), the board will turn a wider arc which provides more stability at speed. The snowboard assembly 10 has blades 30, 40 with straight toe side and heel side edges (i.e. no curve or arc). The side cut is achieved therefore by the pivoting action of the hanger 120. The more the truck assembly 10 is allowed to pivot, the greater the effective sidecut that can be achieved. However, the pivoting action of the truck assembly 100 must be limited, otherwise the blades 30, 40 cannot pick up on their edges effectively in order to turn.

The effective sidecut of the snowboard assembly 10 may also be varied by changing the angle of the pivot axis of the hanger 120 with respect to the deck 20. In the embodiments shown, the pivot axis 60 is set at substantially 45° with respect to the bottom surface 22 of the deck 20. This parameter may be increased or decreased as appropriate in order to vary the effective sidecut.

Figure 22:
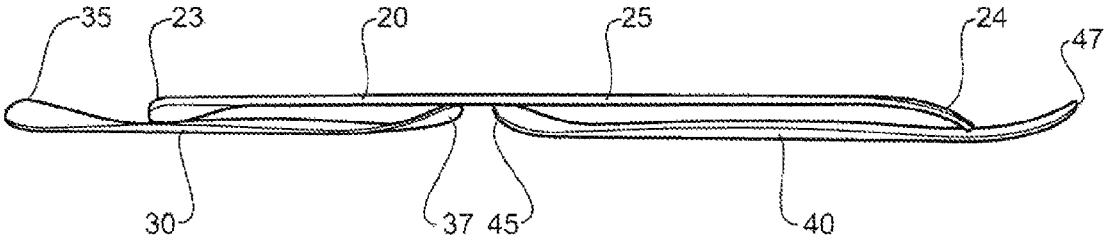
FIG. 22 is a side view of a snowboard assembly according to an embodiment showing flexible interaction between the deck and forward and aft blades.

Referring now to FIG. 22, there is shown an embodiment of the snowboard assembly 10 which illustrates how the flex characteristics and effective sidecut of the snowboard assembly 10 may be influenced by flexible interaction between the deck 20 and blades 30, 40 (the truck assemblies 100 are not shown). The forward tip 23 and aft tip 24 of the deck 20 may contact the blades 30, 40 respectively as shown or alternatively there may be a gap between them such that the tips are contactable with the blades in use. The flexible interaction between the deck 20 and blades 30, 40 allows a user to perform tricks such as manual, alter the flex response of the snowboard assembly 10 as well as the effective sidecut of the blades 30, 40. A user can alter the effective length of an edge of a blade by applying pressure through the tips 23, 24 of the deck 20 into the blades 30, 40. The aft edge 37 of the forward blade 30 and forward edge 45 of the aft blade 40 may also be in permanent contact with the mid-section 25 of the deck 20. This flexible interaction between the deck 20 and blades 30, 40 provides a leaf spring effect that is highly tunable to control the flex memory of the snowboard assembly 10. The forward tip 23 and all tip 24 of the deck 20 need not be integral with the deck 20. In one embodiment, the forward and aft tips may be designed as removable and interchangeable flexing tips which are able to interact with the blades 30, 40.

Figure 24:
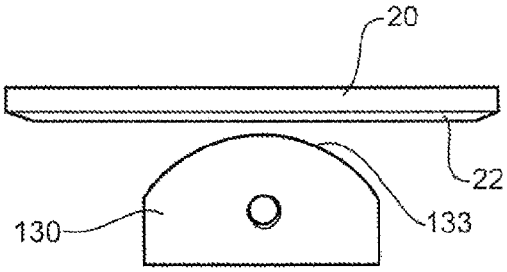
FIG. 24 is a side view of a blade mount and deck arrangement.
Figure 25:
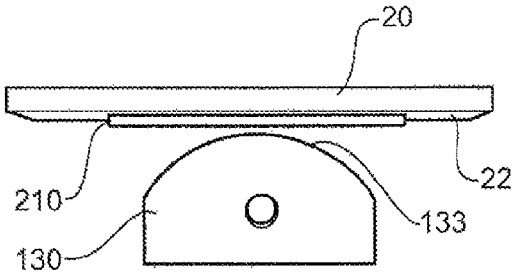
FIG. 25 is a side view of an alternative blade mount and deck arrangement having a wear plate.
Figure 26:
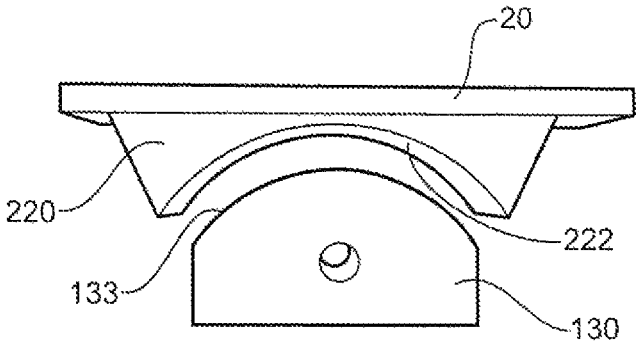
FIG. 26 is a side view of an alternative blade mount and deck arrangement having a cradle.
Figure 27:
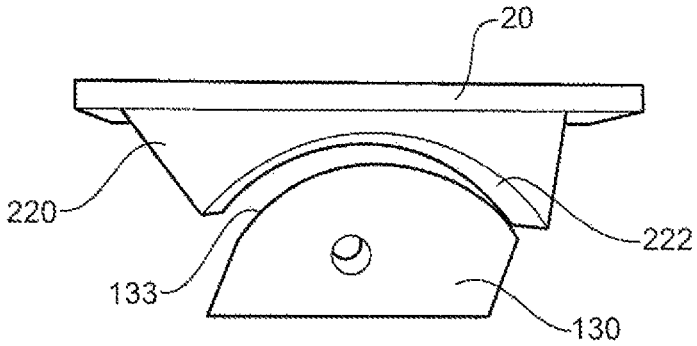
FIG. 27 is a side view of an alternative blade mount and deck arrangement having a cradle and off-centred blade mount.
Figure 28:
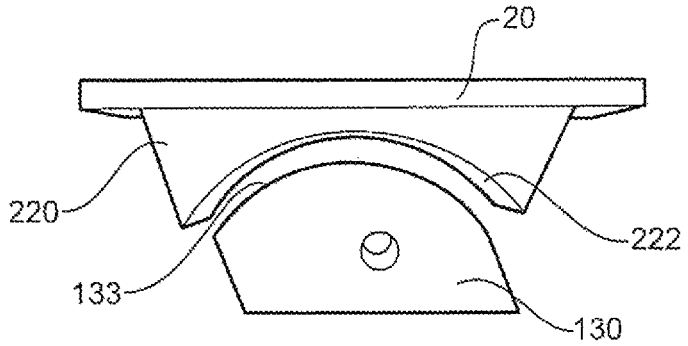
FIG. 28 is a side view of an alternative blade mount and deck arrangement having a cradle and off-centred blade mount.

The blade mounts 130 may be used to precisely tune the sidecut of each blade 30, 40. FIG. 24 provides a schematic view of a blade mount 130 which has an increased height to thereby reduce the gap between the upper surface 133 of the blade mount 130 and the bottom surface 22 of the deck 20. As a rider initiates a turn and the truck assembly 100 starts to pivot, the bottom surface 22 of the deck 20 will come into contact with the upper surface 133 of the blade mount 130 to thereby limit the articulation of the truck assembly 100. Alternatively the profile of the blade mount 130 may stay the same, while a wear pad 210 (of desired thickness) is mounted to the bottom surface 22 of the deck 20 as depicted in FIG. 25. In another embodiment as shown in FIG. 26, a cradle 220 may be mounted to the bottom surface 22 of the deck 20 instead of the wear pad 210. The cradle 220 has an engaging surface 222 that is contactable with the upper surface 133 of the blade mount 130 when executing a turn. The blade mounts 130 may be off-centred as shown in FIGS. 27-28. In FIGS. 27-28, the curvature of the upper surface 133 of the blade mount is not aligned with the curvature of the engaging surface 222 of the cradle 220. Therefore as upper surface 133 engages with engaging surface 222 of the cradle 220, the blade 30, 40 is forced into a position of camber or rocker. This provides the ability for the snowboard assembly 10 to vary between camber, neutral and rocker during a turn. For example, the leaf springs 180 may be set so that the blades 30, 40 are configured into camber when not under load. As a turn is executed, as the blade mount 130 engages with cradle 220, the off-centred blade mounts 130 can function to override the camber setting and force the blade into a rocker configuration.

Figure 29:
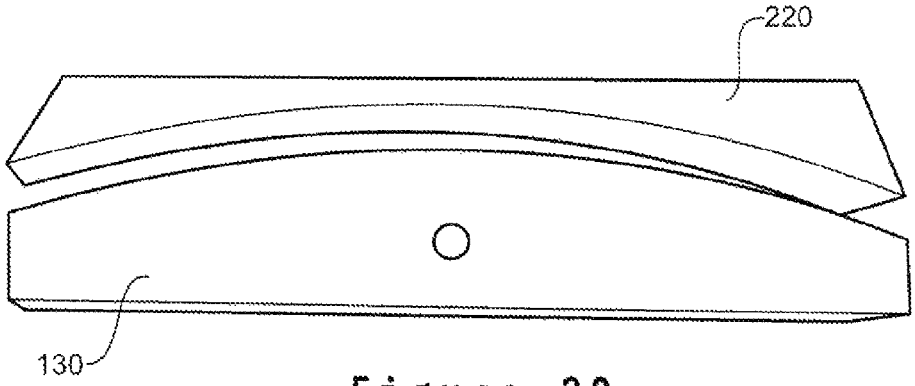
FIG. 29 is a side view of an enlarged blade mount and cradle arrangement.

The cradle 220 and blade mount 130 may be lengthened as shown in FIG. 29 as the length of the snowboard assembly 10 is increased from a nominal 1100 mm up to 1700 mm. Lengthening these components allows them to withstand the increased loads generated by the longer snowboard assembly 10.

Figure 30:
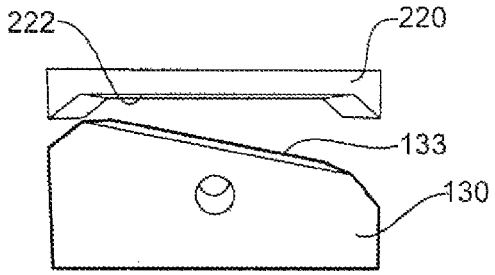
FIG. 30 is a side view of a straight cut cradle and blade mount.
Figure 31:
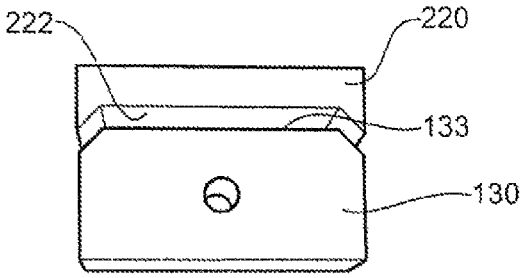
FIG. 31 is a side view of an alternative straight cut cradle and blade mount.
Figure 32:
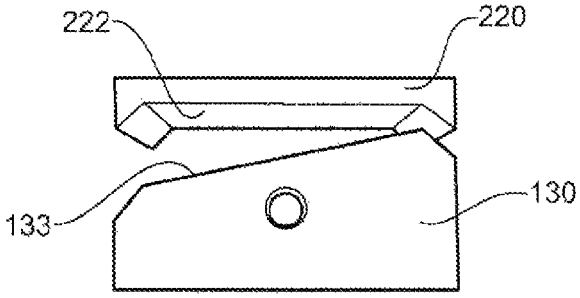
FIG. 32 is a side view of an alternative straight cut cradle and blade mount.
Figure 33:
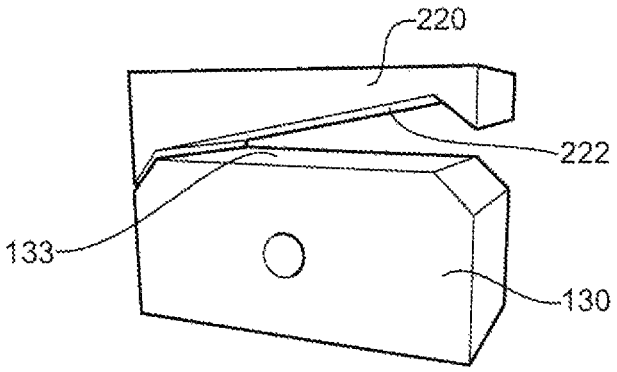
FIG. 33 is a side view of an alternative straight cut cradle and blade mount.
Figure 34:
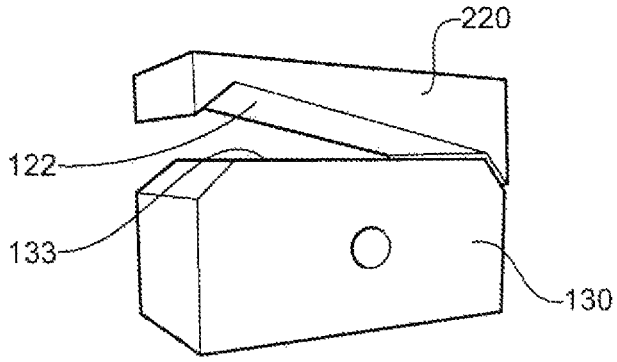
FIG. 34 is a side view of an alternative straight cut cradle and blade mount.

In the embodiments illustrated in FIGS. 26-29 the cradle 220 has a curved engaging surface 222 and the blade mounts 130 have a curved upper surface 133. A higher performance alternative which is designed to minimise the potential for undulation during a turn while setting a precise pitch and angle of the blade is shown in FIGS. 30-34. These figures illustrate a straight cut cradle 220 having a straight engaging surface 222 which is contactable with the upper surface 133 of the blade mount 130 when executing a turn. The upper surface 133 of the blade mount 130 is also straight but may be horizontal or tapered as shown in FIGS. 30-32. In this way, the straight cut cradles 220 and blade mounts 130 of FIGS. 30-32 are able to independently influence camber, neutral or rocker settings into a blade and override the normal setting of a blade set by the leaf springs. Alternatively as shown in FIGS. 33-34, the engaging surface 222 of the cradle 220 may be set at a pitch (i.e. tapered from horizontal) while the upper surface 133 of the blade mount 130 remains horizontal.

Figure 37:
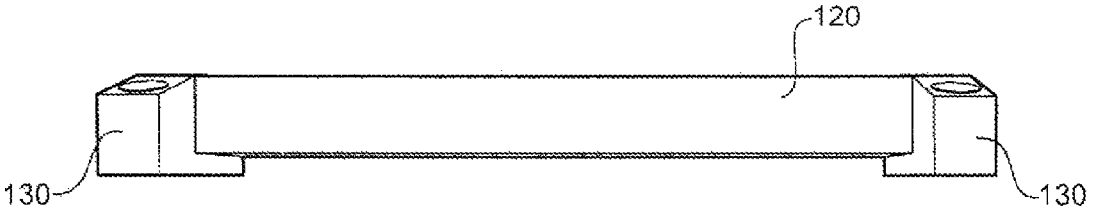
FIG. 37 is a front view of a truck assembly having the hanger directly mounted to the deck.
Figure 38:
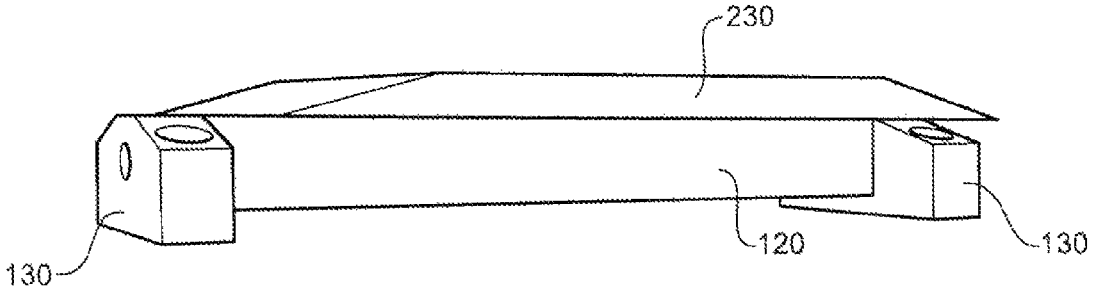
FIG. 38 is a front perspective view of a truck assembly having a load spreading plate mounted between the hanger and deck.
Figure 39:
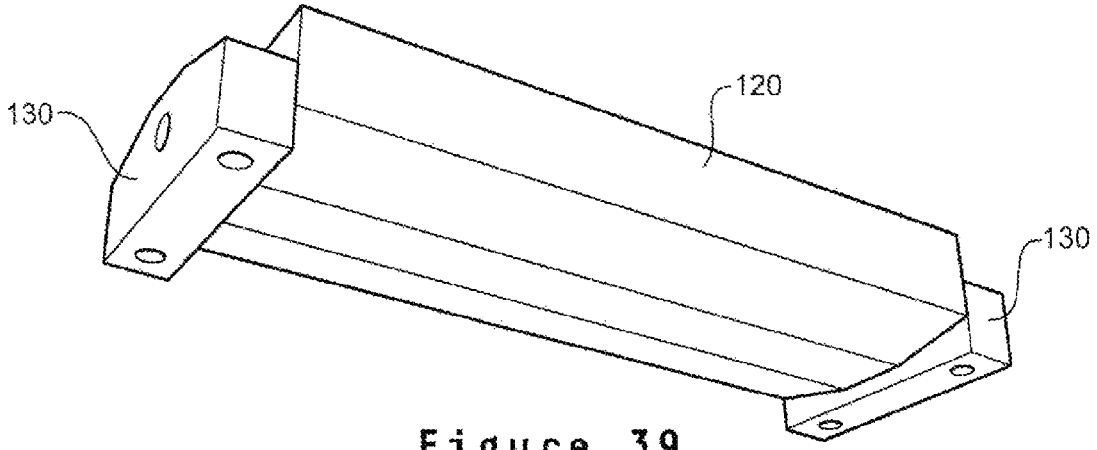
FIG. 39 is a lower perspective view of a truck assembly having an enlarged hanger to spread loads.

Referring now to FIGS. 37-39, there are shown alternative embodiments of the truck assembly 100 with the baseplate removed. In FIG. 37, the hanger 120 is mounted directly to the bottom surface 22 of the deck 20. In this form, the hanger 120 cannot pivot and accordingly the truck assembly 100 is no longer used to execute a turn. For a snowboard assembly 10 in this form, sidecut is introduced by moving from straight edged blades to blades having a sidecut radius. The blades can still undulate through rotation of the blade mounts 130 relative to the hanger 120. FIG. 38 shows a similar modified truck assembly 100 to that shown in FIG. 37 but having an additional load spreading plate 230 to react higher loads. FIG. 39 shows another way that this could be implemented by expanding the dimensions of the hanger 120 to spread load, thus negating the need for any additional load spreading plate.

Figure 35:
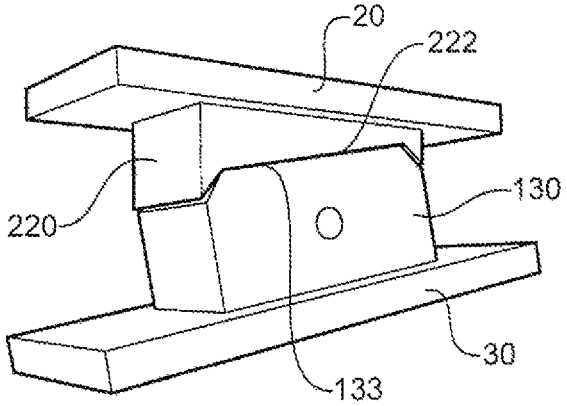
FIG. 35 is perspective view of the blade mount directly mounted between the deck and forward blade.
Figure 36:
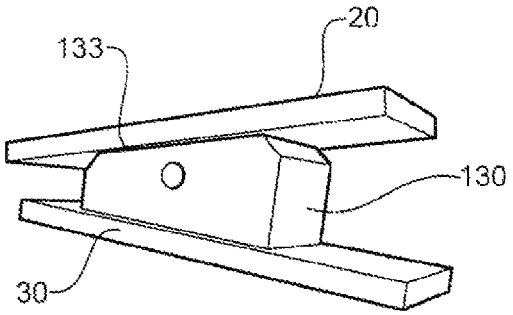
FIG. 36 is perspective view of the blade mount directly mounted between the deck and forward blade.

In some embodiments of the present invention, the truck assembly 100 may be removed entirely. The blades 30, 40 can be coupled to the deck 20 by mounting the blade mounts 130 directly to the bottom surface 22 of the deck 20 as illustrated in FIGS. 35 and 36. This eliminates the undulation and articulation ability of the blades and is a high performance variation of the snowboard assembly 10. The blade mounts 130 may be mounted directly to the bottom surface 22 of the deck 20 (FIG. 35) or alternatively may nest within a cradle 220 as shown in FIG. 36. The pitch of the blades can be set by adjusting the pitch of either the upper surface 133 of the blade mount 130 or alternatively the pitch of the engaging surface 222 of the cradle 220. In this system, the blades 30, 40 must have a sidecut radius to enable the snowboard assembly 10 to turn as the rider shifts their weight appropriately.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A snowboard assembly, comprising:

a pair of longitudinally spaced apart blades, each blade having a bottom surface for contacting ice or snow upon which the snowboard assembly is ridden; and a deck supported above the blades by mounts that are interposed between each blade and the deck, the deck having a top surface for supporting a rider thereon, each mount enabling the blade supported thereby to move independently with respect to the deck, each mount including:

a baseplate securable to a bottom surface of the deck;

an elongate member coupled to the supported blade and pivotally retained with respect to the baseplate; and a pair of laterally spaced apart biasing means which act to return the elongate member to a home position with respect to the baseplate, the biasing means coupled between the baseplate and elongate member to provide resistance against pivotal movement of the elongate member about a pivot axis, wherein the deck is torsionally rigid between the mounts such that, in use, rider induced weight transfer forces are able to be transferred from the deck through one or both mounts and into one or both blades in order to steer the assembly.

2. The snowboard assembly of claim 1 wherein the mounts interposed between each blade and the deck are truck assemblies.

3. The snowboard assembly of claim 1 wherein the elongate member is retained in a recess or channel formed in the baseplate.

4. The snowboard assembly of claim 3 wherein the elongate member is retained in the recess or channel by a retaining plate, the retaining plate including a pivot pin that extends through the elongate member and into the baseplate and wherein the pivot pin defines the pivot axis about which the elongate member is able to pivot with respect to the baseplate and deck.

5. The snowboard assembly of claim 4 wherein the recess or channel formed in the baseplate restricts an amount that the elongate member is able to pivot about the pivot axis.

6. The snowboard assembly of claim 5 wherein the recess or channel provides tapered surfaces that are contactable with the elongate member and which provide hard stops to restrict the amount that the elongate member is able to pivot about the pivot axis.

7. The snowboard assembly of claim 4 wherein the pivot axis is angled at substantially 45° with respect to the bottom surface of the deck.

8. The snowboard assembly of claim 1 wherein the elongate member is coupled to the blade through a pair of spaced apart blade mounts upstanding from a top surface of the blade adjacent opposing lateral edges thereof.

9. The snowboard assembly of claim 8 wherein the blade mounts are pivotally coupled to the elongate member.

10. The snowboard assembly of claim 8 wherein the deck is contactable with the blade mounts when the elongate member pivots thereby providing means to vary the effective sidecut of the snowboard assembly.

11. The snowboard assembly of claim 1 wherein the elongate member is a bar having a rectangular cross-section.

12. The snowboard assembly of claim 11 wherein the elongate member has cylindrical end portions and the blade mounts are pivotally coupled to the cylindrical end portions.

13. The snowboard assembly of claim 12 wherein the truck assembly further includes additional biasing means which act to return the blade mounts and blade to a home position with respect to the deck.

14. The snowboard assembly of claim 13 wherein the additional biasing means which act to return the blade mounts and blade to a home position with respect to the deck comprise a pair of leaf springs mounted to the elongate member about opposing sides of the baseplate, the leaf springs contactable with the top surface of the blade and operable to provide resistance against pivotal movement of the blade mounts and blade with respect to the elongate member.

15. The snowboard assembly of claim 1 wherein the biasing means comprise springs.

16. The snowboard assembly of claim 1 wherein the deck has flexible forward and aft tips contactable with the blades.

17. The snowboard assembly of claim 1 wherein the deck terminates in downwardly sloped sections.

18. The snowboard assembly of claim 1 wherein the blades have flexible upswept tips that are contactable with the deck.

19. The snowboard assembly of claim 18 wherein the flexible upswept tips of each blade are able to flex up under snow pressure, thereby reducing edge contact between the blades and snow to assist turning in soft or powder snow.

20. The snowboard assembly of claim 1 wherein the blades have straight metal edges for cutting into snow or ice to perform a turn.

21. The snowboard assembly of claim 1 wherein, for each blade, the mounts comprise a pair of spaced apart blade mounts upstanding from a top surface of the blade adjacent opposing lateral edges thereof, said blade mounts secured to both the blade and a bottom surface of the deck.

22. A snowboard assembly, including:

a pair of longitudinally spaced apart blades having upswept flexible tips, each blade having a bottom surface for contacting ice or snow upon which the snowboard assembly is ridden; and a deck having a top surface for supporting a rider thereon and flexible tips, the deck supported above each blade by a mount interposed between each blade and the deck, each mount enabling the blade supported thereby to move independently with respect to the deck, each mount including:

a baseplate securable to a bottom surface of the deck;

an elongate member coupled to the blade and pivotally retained with respect to the baseplate; and a pair of laterally spaced apart biasing means which act to return the elongate member to a home position with respect to the baseplate, the biasing means coupled between the baseplate and elongate member to provide resistance against pivotal movement of the elongate member about a pivot axis, wherein, the deck is torsionally rigid between each truck assembly such that, in use, rider induced weight transfer forces are able to be transferred from the deck through one or both truck assemblies and into one or both blades in order to steer the assembly and wherein the flexible tips of the deck are contactable with the blades and the flexible tips of the blades are contactable with the deck.

23. A snowboard assembly, including:

a pair of longitudinally spaced apart blades, each blade having a bottom surface for contacting ice or snow upon which the snowboard assembly is ridden; and a deck supported above the blades by mounts that are interposed between each blade and the deck, the deck having a top surface for supporting a rider thereon, each mount enabling the blade supported thereby to move independently with respect to the deck, each mount including:

a baseplate securable to a bottom surface of the deck; and an elongate member coupled to the blade and pivotally retained with respect to the baseplate such that the elongate member is retained in a recess or channel formed in the baseplate by a retaining plate, the retaining plate including a pivot pin that extends through the elongate member and into the baseplate, wherein the pivot pin defines a pivot axis about which the elongate member is able to pivot with respect to the baseplate and deck, wherein the deck is torsionally rigid between the mounts such that, in use, rider induced weight transfer forces are transferable from the deck through one or both mounts and into one or both blades in order to steer the assembly.

24. A snowboard assembly, including:

a pair of longitudinally spaced apart blades, each blade having a bottom surface for contacting ice or snow upon which the snowboard assembly is ridden; and a deck supported above the blades by mounts that are interposed between each blade and the deck, the deck having a top surface for supporting a rider thereon, each mount enabling the blade supported thereby to move independently with respect to the deck, each mount including:

a baseplate securable to a bottom surface of the deck; and an elongate member coupled to the blade and pivotally retained with respect to the baseplate;

wherein the snowboard assembly further includes biasing means which act to return the blade mounts and blade to a home position with respect to the deck, the biasing means comprising a pair of leaf springs mounted to the elongate member about opposing sides of the baseplate, the leaf springs contactable with the top surface of the blade and operable to provide resistance against pivotal movement of the blade mounts and blade with respect to the elongate member, and wherein the deck is torsionally rigid between the mounts such that, in use, rider induced weight transfer forces are transferable from the deck through one or both mounts and into one or both blades in order to steer the assembly.

25. A snowboard assembly, including:

a pair of longitudinally spaced apart blades, each blade having a bottom surface for contacting ice or snow upon which the snowboard assembly is ridden; and a deck supported above the blades by mounts that are interposed between each blade and the deck, the deck having a top surface for supporting a rider thereon, each mount enabling the blade supported thereby to move independently with respect to the deck, each mount including:

a baseplate securable to a bottom surface of the deck; and an elongate member coupled to the supported blade and pivotally retained with respect to the baseplate;

wherein the elongate member is coupled to the blade through a pair of spaced apart blade mounts upstanding from a top surface of the blade adjacent opposing lateral edges thereof, wherein the deck is contactable with the blade mounts when the elongate member pivots thereby providing means to vary the effective sidecut of the snowboard assembly, and wherein the deck is torsionally rigid between the mounts such that, in use, rider induced weight transfer forces are transferable from the deck through one or both mounts and into one or both blades in order to steer the assembly.

* * * * *